US005988261A

United States Patent [19]

Milorad et al.

[11] Patent Number: 5,988,261

[45] **Date of Patent: *Nov. 23, 1999**

[54] CONTINUOUS CASTING METHOD AND RELATIVE CRYSTALLISER FOR CONTINUOUS CASTING

[75] Inventors: Pavlicevic Milorad, Udine, Italy; Anatoly Kolesnichenko, Kiev, Ukraine; Alfredo Poloni, Fogliano Di Redipuglia, Italy

[73] Assignee: Danieli & C. Officine Meccaniche SpA, Udine, Italy

[ * ] Notice: This patent is subject to a terminal disclaimer.

[21] Appl. No.: 08/855,360

[22] Filed: May 13, 1997

[30] Foreign Application Priority Data

May 13, 1996 [IT] Italy ..... UD96A0076

[51] Int. Cl.[6] ..... B22D 27/02

[52] U.S. Cl. ..... 164/466; 164/468; 164/502; 164/504

[58] Field of Search ..... 164/466, 468, 164/502, 504, 498, 499, 500, 147.1, 478, 416

[56] References Cited

U.S. PATENT DOCUMENTS

| | | | |
|---|---|---|---|
| 4,419,177 | 12/1983 | Pryor et al. | 164/504 |
| 4,522,249 | 6/1985 | Mulcahy | 164/478 |

FOREIGN PATENT DOCUMENTS

| | | | |
|---|---|---|---|
| 277889 | 8/1988 | European Pat. Off. . | |
| 1174154 | 8/1985 | U.S.S.R. | 164/504 |
| 95-13154 | 5/1995 | WIPO . | |

OTHER PUBLICATIONS

Patent Abstracts of Japan vol. 6, No. 1 (M–105) Jan. 7, 1982 & JP–A–56 126048 (Mitsubishi Jukogyo) Oct. 3, 1981 Abstract.

Patent Abstracts of Japan vol. 5, No. 76 (M–76) [748] May 20, 1981 & JP–A–56 026660 (Shin Nippon) Mar. 14, 1981) abstract.

Patent Abstracts of Japan vol. 10 No. 96 (M–469) [2153] Apr. 12, 1986 & JP–A–60 231554 (Kobe) Nov. 18, 1985 abstract.

*Primary Examiner*—Kuang Y. Lin

*Attorney, Agent, or Firm*—Antonelli, Terry, Stout & Kraus, LLP

[57] ABSTRACT

Crystalliser for the continuous casting of billets, blooms, slabs and round bars, whether the crystalliser be of the plate type or substantially tubular, having cooled sidewalls (11) which include, in at least one longitudinal area, at least one perimeter area with electrical insulation elements (19) defining two electrically insulated ends, the sidewall of the crystalliser (10) included between the aforesaid two insulated ends having an electrical continuity, the ends being associated to electrical feed means (22) governed by a power supply system able to generate electromagnetic waves, defined and desired, interacting at least with the forming skin of the cast metal (12). Continuous casting method for billets, blooms, slabs, round bars and other products, used in a crystalliser (10) containing the cast metal (12), as shown above, at least the forming skin of the cast metal (12) inside the crystalliser (10) undergoing the action of a pulsating magnetic field generated by connecting at least two electrically insulated ends of at least one circumferential part of at least one longitudinal part of the sidewalls (11) of the crystalliser (10) to an electrical power source, the electrical power source inducing on the cast metal (12) pulsating currents of an intensity up to 150 kA.

25 Claims, 3 Drawing Sheets

CONTINUOUS CASTING METHOD AND RELATIVE CRYSTALLISER FOR CONTINUOUS CASTING

BACKGROUND OF THE INVENTION

This invention concerns a continuous casting method with a pulsating magnetic field along the crystalliser and the relative crystalliser for continuous casting.

The invention is applied to machines performing continuous casting of billets, blooms and slabs, particularly thin slabs, in the field of the production of iron and steel.

The state of the art of the continuous casting field covers the use of electromagnetic devices associated externally with the sidewalls of a crystalliser and able to generate an electromagnetic field interacting with the molten metal being cast.

In the state of the art this electromagnetic field mainly has the purpose of improving the surface quality of the product, principally by acting on the liquid metal so as to improve the characteristics of solidification; another purpose is to displace the surface of the molten metal in the zone of the joint between the refractory material and the crystalliser so that the solidification begins only in the crystalliser and there are no leakages of material.

The electromagnetic devices of the state of the art normally comprise a coil or one single inductor positioned in cooperation with the outside of the wall of the crystalliser and generally close to the zone of the beginning of solidification of the metal.

Embodiments have been disclosed in which the coil or inductor generates a stationary alternating magnetic field (see the article "Improvement of Surface Quality of Steel by Electromagnetic Mold" taken from the documents of the International Symposium on the "Electromagnetic Processing of Materials"—Nagoya 1994) or else generates an alternating magnetic field modulated in amplitude (see the article "Study of Meniscus Behavior and Surface Properties During Casting in a High-Frequencies Magnetic Field" taken from "Metallurgical and Materials Transaction"—Vol. 26B, April 1995).

Other embodiments disclosed provide for the magnetic field generated to be periodically pulsating with waves defined by successions of pulses of a substantially constant amplitude (U.S. Pat. No. 4,522,249) or else for the magnetic field to be generated by electromagnetic waves of a development which is attenuated until it is eliminated within a half-period (SU-A-1021070 and SU-A-1185731).

Experimental tests have shown that such configurations of the electromagnetic field acting in the crystalliser are not suitable to achieve the desired results in view of the different conditions which occur within the solidifying metal.

These different conditions, which are due to the different physical state and different temperature of the solidifying metal, cause an interaction between the magnetic field and the metal, this interaction being different from one zone of the crystalliser to the other and therefore not the best along the whole length of the crystalliser.

Moreover, in the state of the art, there are problems in the connection between the inductors outside the crystalliser and the crystalliser itself as regards dispersions in and attenuations of the electromagnetic field generated, which causes a reduction in the intensity of the forces acting on the molten metal.

There is also the problem of the mechanical deformation to which the inductors may be subjected during use.

Particularly, but not only, the state of the art does not make possible to fulfill the following functions:

to reduce the friction between the cast product and the crystalliser by inducing pulsating forces directly onto the solid skin, and also onto the liquid part where that is necessary, in order to increase the casting speed;

not to use the traditional systems of mechanical oscillation of the ingot mold with a consequent improvement of the surface quality of the product, as the oscillation marks are eliminated;

to control the effect on the meniscus according to the requirements of the process so as to improve both the lubrification of the sidewall and also the surface quality and the inner quality of the product;

to use the capacity of resonance of the solidified skin and the skin-liquid system so as to improve the heat exchnage in the mushy zone in order to encourage a growth of the product with an equal axis and a consequent improvement in the inner quality;

to use the migrating field configuration so as to induce in the liquid part a vertical stirring (direction of the axis of the crystalliser) so as to obtain an optimum effect;

to improve the heat exchange in the lower part of the crystalliser where the skin is separated from the crystalliser, thus increasing the total quantity of the heat removed by the crystalliser, thus making it possible to achieve higher casting speeds and improvements in the quality of the product.

SUMMARY OF THE INVENTION

The present applicants have designed, tested and embodied this invention to overcome these shortcomings and to achieve further advantages.

The purpose of this invention is to provide a method of continuous casting applied to a crystalliser for billets, blooms, slabs or round bars, and the relative crystalliser, which will be able to fulfill at least the following conditions in an optimum manner:

to reduce the friction between the cast product and the crystalliser by inducing pulsating forces directly onto the solid skin, and also onto the liquid part where necessary, in order to increase the casting speed;

not to use the traditional systems of mechanical oscillation on the ingot mold and therefore on the crystalliser, with a consequent improvement in the surface quality of the product, as the oscillation marks are eliminated;

to control the effect at the meniscus according to the requirements of the process so as to improve both the lubrification and the surface and inner quality of the product;

to exploit the capacity of resonance of the solidified skin and of the skin-liquid system so as to improve the heat exchange in the mushy zone in order to encourage a growth of the product with an equal axis and a consequent improvement in the inner quality of the continuously cast product;

to use the migrating field configuration so as to induce into the liquid part a vertical stirring (direction of the axis of the crystalliser) so as to obtain an optimum result of the cast product;

to improve the heat exchange in the lower part of the crystalliser where the skin is separated from the crystalliser and thus increase the total quantity of heat removed by the crystalliser, making it possible to achieve higher casting speeds and improving at the same time the quality of the product.

The invention is achieved by a method of continuous casting applied to a crystalliser for billets, bloom, slabs or round bars, and the relative crystalliser, which uses the generation of a pulsating magnetic field, which is variable along the whole lengthwise extent of the crystalliser, where it is the crystalliser itself which acts as an inductor.

According to the invention, there are no inductors outside the crystalliser, and the magnetic field is generated by connecting the sidewalls of the crystalliser directly, where two electrically insulated ends are defined, by means of an electrical power supply.

In other words, in the crystalliser according to the invention, whether it be of the plate type or tubular type, at least one corner is electrically insulated, in such a way as to define two separate ends which are connected with the electrical supply system, while electrical contact is established between the other corners.

In this case reference is made to corners for reasons of simplification, meaning that, for example, in a crystalliser for the casting of round bars there is an interruption which defines the two insulated ends used for the electrical power supply.

The inner walls of the crystalliser are lined by a thin insulating layer, advantageously having good heat conducting characteristics, so as to prevent a direct electrical contact between the molten metal and the walls of the crystalliser.

The insulating layer may be made of $Br_2C+Al_2O_3$ or of $Al_2O_3$, or of AlN or of amorphous diamond carbon.

With this arrangement, by correctly connecting the conductors which feed the current to the various vertical areas of the walls of the crystalliser, it is possible to correlate the individual longitudinal areas of the crystalliser to different parameters of current intensity and current timing, as well as of the pulse form.

Therefore, it is possible with the invention to generate electromagnetic forces which differ from zone to zone so as to obtain a desired and variable effect along the crystalliser.

Moreover, with this invention currents of greater intensity can be induced on the cast product, thus obtaining forces of a higher intensity, compared with that obtained when external inductors are used.

According to a first embodiment of the invention, the crystalliser is obtained lengthwise and substantially in a single body.

According to a variant, the crystalliser is sub-divided lengthwise into precise areas, and each area is insulated with respect to the adjacent areas.

According to a further variant, the individual areas are cooled in an autonomous manner.

And again, different longitudinal areas can be defined along the crystalliser, to a required number and extent, each one connected to specific channels of the power supply, and characterised by their own specific parameters of power supply, thus obtaining an extremely flexible system which can be adapted to the different requirements both of the cast product and to those which occur during casting.

By correctly staggering the power supply to these individual longitudinal areas of the crystalliser, or by not supplying alternatively one or the other of these areas, it is possible to set in vibration the cast product by exciting it locally.

According to a variant, the frequencies of excitation of the molten metal are those which substantially correspond to the frequencies of resonance, which are different at different points on the crystalliser according to the specific physical state and specific temperature of the metal.

By getting as close as possible to the condition of resonance of the cast product in the crystalliser along the whole longitudinal extent thereof, it is possible to obtain a high amplitude of the vibrations and a greater intensity of the electromagnetic forces acting on the solid skin.

This condition of resonance achieved in a variable manner and with variable parameters along the longitudinal extent of the crystalliser generates a better condition for separation of the skin from the sidewalls of the crystalliser and an easier and faster downward sliding of the metal.

Using the crystalliser according to the invention it is possible to control in a differentiated way the force exerted on the cast product, both in intensity and in the frequency of application; likewise it is possible to control the parameters of solidification of the skin at various points along the crystalliser. In particular, it is possible to control the effect of those forces on the skin of the cast product, thus avoiding the risk of the skin breaking by means of reducing the forces of friction by controlling the vibrations induced.

Moreover, it is possible to increase the heat exchange between the cast metal and the solidified skin, through a stirring action; the effect of this action operates in a vertical direction with a series of squeezing pulsations in the cast material which take place at different times and at different positions along the crystalliser so as to cause a real global movement (i.e., an effective movement caused by the pulsation which affects the entire liquid part of the material) in the liquid part of the material.

Also, it is possible with the invention to control the heat exchange between the solidified skin and the crystalliser in a differentiated manner, according to specific requirements. This also enables the casting speed to be increased.

According to the invention, this arrangement allows volumetric waves (i.e., waves which cause the shifting of a volume of the molten metal) to be formed on the surface of the meniscus in such a way as to define the formation of a gap between the just solidifed skin and the sidewall of the crystalliser, which enables a lubricant (oil and/or powders) to be introduced.

The volumetric waves can be of the almost stationary type, or of the stationary type, allowing a gap of a substantially fixed dimension to be formed, between the just solidified skin and the sidewall of the crystalliser.

It is thus possible to improve the introduction of the lubricant, or to not use it, or to use less of it.

According to a variant, these waves are of the progressive type and move towards the centre, reaching at the centre a desired maximum amplitude, and causing a periodical separation of the solidified skin from the crystalliser, thus determining a sort of "pump effect" (i.e., the effect obtained by the progressive wave toward the center of the crystalliser); this separation enables the lubricant to be introduced periodically.

This periodical movement also causes the gases in the local atmosphere to move at supersonic speed, which in turn causes an increase in the heat exchange.

An efficient electromagnetic stirring along the whole longitudinal extent of the crystalliser leads to a more uniform inner micro-structure of the cast product.

According to one embodiment of the invention, electromagnetic forces of a greater intensity are generated in the lower part of the crystalliser than those generated in the upper part of the crystalliser.

According to another embodiment of the invention, the current pulses have a retarded development (i.e., a development which, for example progressively varies in a delayed manner starting from the top of the crystalliser, so that the field produced takes on a configuration of sequences built-up on each other with a progressively increasing intensity.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1:
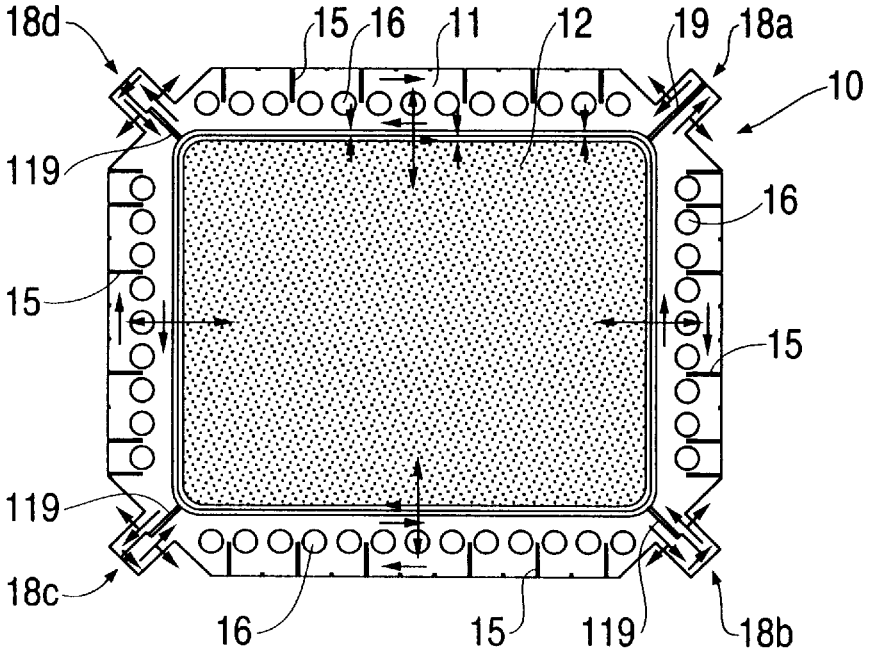
FIG. 1 shows a transverse section of the crystalliser according to the invention.

FIGS. 1 and 2 show partial diagrams of a transverse section and a longitudinal section of a crystalliser 10 for the continuous casting of billets, blooms or slabs, with sidewalls 11.

The molten metal cast in the crystalliser 10 becomes progressively solidified and forms an outer shell of solidified skin 13 having a growing thickness starting from the meniscus 14 and increasing to the outlet of the crystalliser 10. This outer shell of solidified skin 13 defines a distance or gap 17 between itself and the relative sidewall 11 of the crystalliser 10, the value of the gap 17 increasing progressively towards the outlet of the crystalliser 10.

At least where the crystalliser 10 is of a tubular type or of a like type, outside the sidewalls 11 of the crystalliser 10 there is a channel 16 of a very small width through which the cooling liquid flows.

Where the crystalliser 10 is of the type consisting of plates, the cooling channels 16 are provided within the plates themselves, thus enabling the cooling liquid to be brought very close to the cast metal and improving in this way the efficiency of the cooling.

In FIG. 1, the crystalliser 10 is composed of four plates connected to each other in such a way as to define an electrically insulated corner, in this case the corner 18*a*, while the other corners are joined in such a way as to ensure a reciprocal electrical contact.

In this case, the insulation in correspondence with the corner 18*a* is achieved by means of an insulating layer 19, for example a 2 mm layer of $Al_2O_3$ fibre. The other corners 18*b*, 18*c* and 18*d* are connected to each other so as to ensure the passage of the electric current.

In this case, the contact is made in such a way that the reciprocal electrical connection occurs in a distant position from the inner corner near the cast metal 12.

This is achieved by inserting the insulating layer 119 only in the first segment of the corner and making a good electrical contact in the remaining part (FIG.1).

Figure 4C:
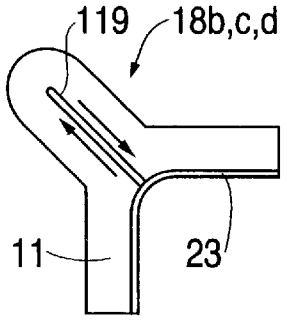
FIGS. 4*a*, 4*b*, 4*c* and 4*d* show a detail of four possible variants adopted in the crystalliser according to the invention.
Figure 4A:
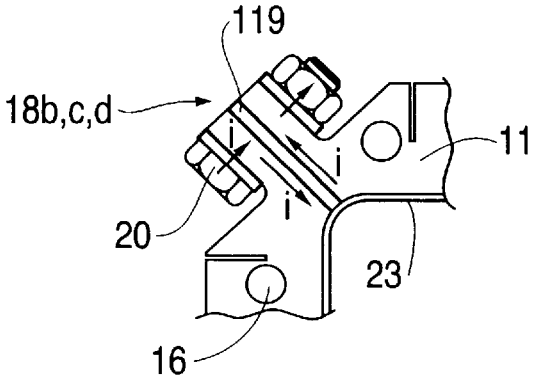

According to the variant shown in FIG. 4*a*, the insulating layer 119 is placed all along the corner and the electrical contact is made by means of a conductor screw 20 or other type of conductor insert.

Figure 4B:
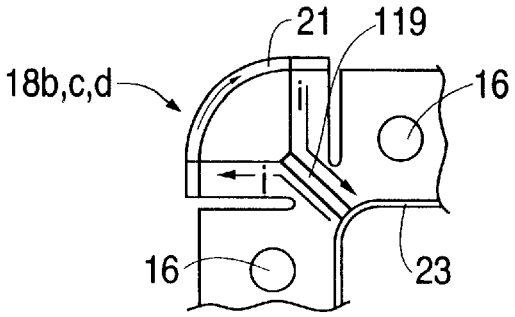
Figure 4D:
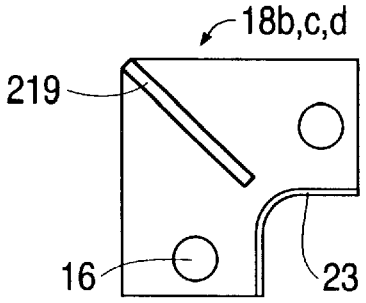

According to the variant shown in FIG. 4*b*, the electrical connection is made by means of an external conductor bridge 21, of the rigid or flexible type.

According to the variant shown in FIG. 4*c*, which refers to a tubular-type crystalliser 10, the electrical contact between the corners 18*b*, 18*c* and 18*d* is made by bending back the sidewalls onto an insulating layer 119 which is only present in the first segment of the corner.

The inner sidewalls of the crystalliser 10 are lined with an insulating layer 23 to prevent a direct electrical contact between the cast metal 12 and the sidewall; the insulating layer 23 has a high quality electrical insulation and at the same time good heat conducting qualities, of between 30 and 1000 W/mK.

The two insulated ends defined in correspondence with the insulated corner 18*a* are connected to the power supply system by means of insulated cables 22, individually connected to the channels of the power supply.

According to this embodiment, by connecting the cables 22 to different channels of the power supply it is possible to distribute the currents, and therefore the relative electromagnetic forces which have been generated, in a differentiated manner along the crystalliser in such a way as to obtain on the cast metal 12 the desired effects according to the requirements of the casting.

Each channel of the power supply can provide differentiated pulses in the individual longitudinal areas of the crystalliser 10 in terms of form, duration, frequency of repetition, intensity of current.

These pulses can typically have a duration of between 5 and 5000 $\mu$s, a frequency of repetition of between 2 and 100 Hz and a maximum current intensity on the crystalliser of about 150 kA, according to the type of application and the longitudinal area associated with the specific channel of the power supply.

For example, in correspondence with the meniscus, the force induced has a frequency of application included in the interval 5–60 Hz and has a minor intensity, while in the lower part of the crystalliser 10 the frequency is in the interval of 5–40 Hz and has a higher intensity.

By connecting the sidewalls 11 of the crystalliser 10 to the power supply, it is possible to induce on the cast metal 12 currents of high intensity, as much as 150 kA and therefore to obtain forces of a higher intensity than those produced by using external inductors.

Moreover, the flexibility of the system can be increased by defining a desired plurality of different longitudinal areas of the crystalliser 10 according to the different behaviour of the cast metal 12 along the crystalliser 10.

The invention makes it possible, for each channel of the power supply, to distribute or concentrate the corresponding current and therefore the forces along the crystalliser 10.

Figure 2A:
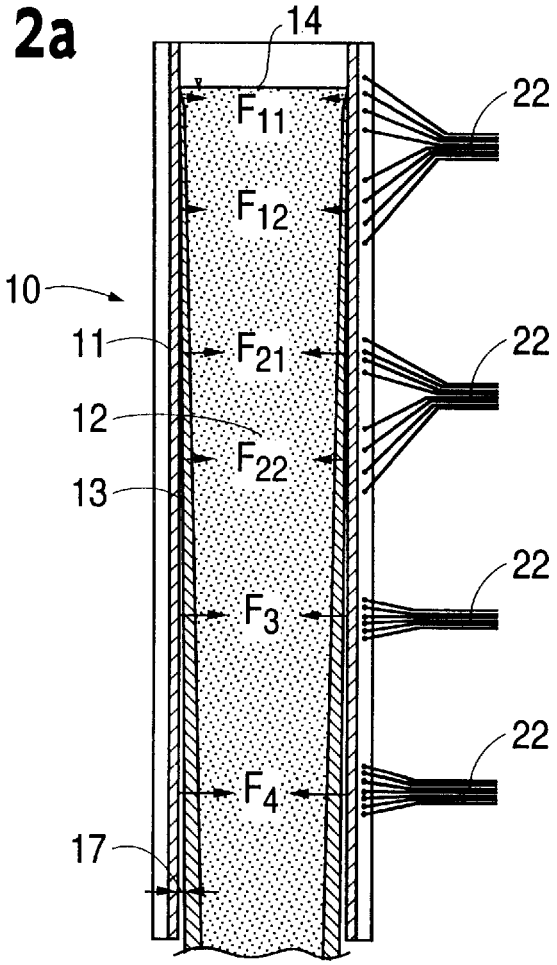
FIGS. 2*a*, 2*b* and 2*c* show some possible longitudinal sections of the crystalliser in FIG. 1 on a reduced scale.
Figure 2C:
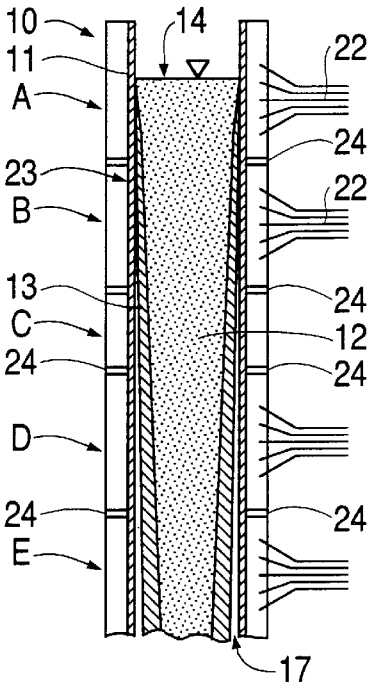

FIG. 2*a* shows how for example the current produced in the first two channels of the power supply can be divided respectively into two areas, thus distributing the relative forces $F_{11}$ and $F_{12}$, $F_{21}$ and $F_{22}$; while in the other two channels of the power supply, in this case, the concentrated currents give rise to the more localised forces $F_3$ and $F_4$.

The forces generated by the different channels of the power supply vary in time within a period according to the electromagnetic wave generated which is generally different for each channel of the power supply.

It follows that these forces will vary in time as well as in space; at a certain moment it may be that the forces relative to a certain channel will have an opposite direction to those of other channels.

The electromagnetic field generated may make it possible to obtain conditions at least near the condition of resonance in the cast metal along the whole longitudinal extent of the crystalliser 10, differentiating the power parameters according to the different physical state of the cast metal 12 along the crystalliser 10.

For example, the frequency of resonance of the metal 12 when it has at the same time both a liquid stage and a solid stage is between about 10 and 30 KHz, that of the solidified skin goes from about 1 to 10 KHz and the frequency of oscillation of the free surface for the liquid part goes from about 5 to about 70 KHz.

This condition of resonance, by amplifying the value of the vibrations, increases their effectiveness given that the parameters of power supply, distance and thicknesses etc. are the same.

Moreover, it is possible to obtain a migration of the electromagnetic field starting from the top of the crystalliser 10 downwards with a progressively increasing intensity of the pulses.

The electromagnetic forces induced generate in the molten metal 12 and on the solidifying skin 13 a desired action of vibration able to limit the problems of adherence to the sidewalls 11 of the crystalliser 10 and to facilitate the downward sliding of the cast product.

Figure 3:
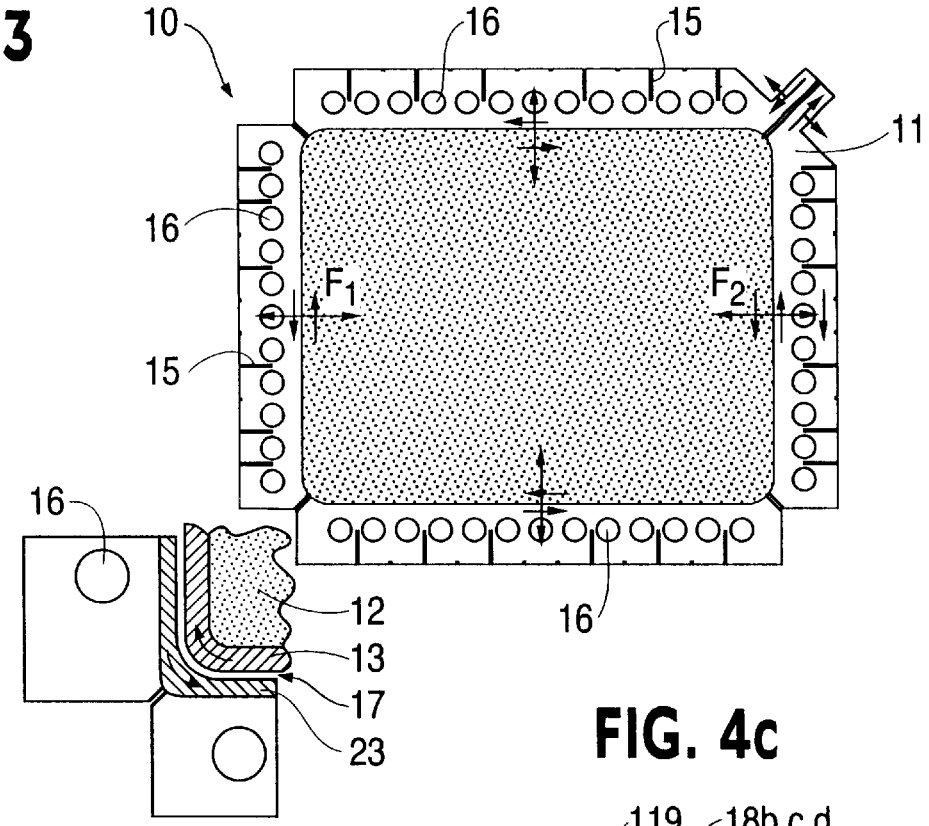
FIG. 3 shows a variant of FIG. 1.

In order to obtain a good distribution of the electromagnetic forces on the cast metal 12, the crystalliser 10 according to the invention is predisposed to concentrate the current in correspondence with the corners 18*b*, 18*c*, and 18*d*. In one embodiment of the invention (FIG.3), the concentration of the current is obtained by reducing the section of the sidewalls 11 of the crystalliser 10 in correspondence with the corners 18*b*, 18*c* and 18*d*.

According to the variant shown in FIG. 4, this concentration is obtained by means of a crystalliser 10 with thick walls where there are insulating inserts 219 in correspondence with the corners 18*b*, 18*c* and 18*d*, which conduct electricity.

According to another variant, the sidewalls 11 have on their outer side notches 15 which make the currents flow with greater efficiency near the surface of the cast metal 12.

The invention includes a specific solution to prevent the formation of a negative influence between the different channels, which could in part diminish the efficacity of the invention. This is due to the fact that the effect of each channel 22 would not be completely confined to its own area of competence (i e., the area in which it efficiently influences the crystalliser), but would extend into the areas of competence of the other channels and thus reduce the efficiency thereof (for example, in FIG. 2 the area of competence of $F_3$ would extend in fact over at least part of the lengthwise extent of the crystalliser).

Figure 2B:
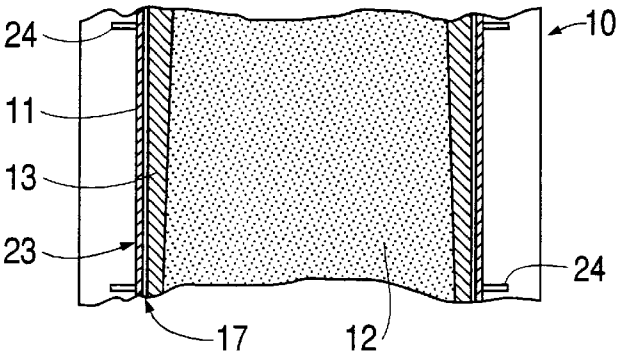

In order to solve this problem, the invention provides for thin (0.3 mm) transversal notches 24 made on the inner face of the crystalliser under the insulating layer 23, at the appropriate heights, along at least part of the perimeter edge, of the crystalliser, when the crystalliser is tubular, and in at least some plates, at the appropriate heights, when the crystalliser is of the type including plates, as shown in FIG. 2*b*. Pairs of these notches 24 delimit the specific zones of action of the power supply means 22.

The depth of the notches 24 according to the invention shall be at least equal to the depth of penetration of the current into the crystalliser, that is to say, 1–5.

For mechanical reasons it is useful to fill the notches 24 with the appropriate materials. According to a first embodiment, this material can be insulating ceramic material. According to another embodiment, in order to increase the longitudinal impedence in the depth of penetration of the inner face of the crystalliser, it is possible to use materials with a high magnetic permeability, (see for example thin core laminations for high frequency transformers).

According to another variant, in order to ensure the coating 23 keeps a good grip, the notches are filled with a material with a low electrical conductivity compared with Cu, but with a similar coefficient of expansion (for example Ni).

According to a further variant, in order to improve the separation, and therefore the independence of the different supply channels from each other, the invention provides to divide the crystalliser into transverse "slices" A,B,C,D and E, electrically insulated from each other (see FIG. 2*c*) but such as to allow the cooling fluid to pass in the appropriate channels, in the case that the crystalliser is of the type including plates, or in any case not to allow any infiltration inside, in the case of a tubular crystalliser cooled on the outside.

The different areas of the crystalliser must be electrically insulated with respect to each other, for example by means of an opportune coating or better, by means of an opportune ferromagnetic material, electrically insulated (for example, core laminations for high frequency transformers).

Figure 5A:
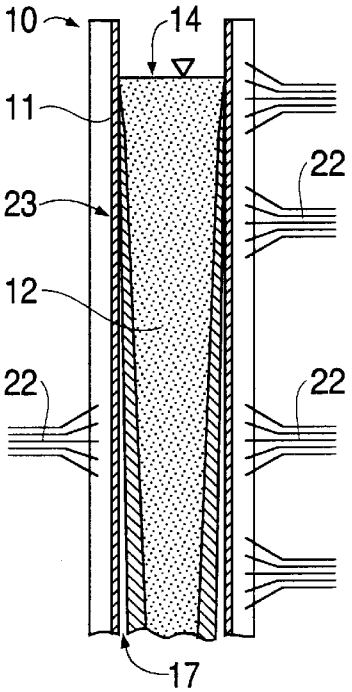
FIGS. 5*a* and 5*b* show a further variant.
Figure 5B:
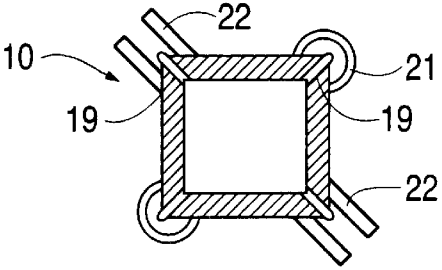

According to the invention, in order to increase the force which may be applied in one area of the crystalliser, the said area is fed by means of a connection in series of several channels of the power supply. For example, FIGS. 5*a* and 5*b* show the case for a square section.

Figure 6:
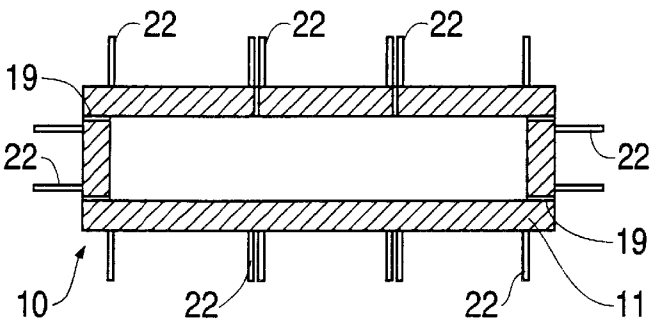
FIG. 6 shows a variant applied to a rectangular crystalliser.

In the case of rectangular sections for slabs, it is very difficult to achieve current pulses of a high amplitude in the cast product because of the high impedence of the system. For this reason, the invention provides for the use of several channels connected in parallel to the crystalliser, as shown in FIG. 6, which make it possible to obtain higher currents in the product.

The channels can operate on the whole face of the plate or on defined zones thereof.

We claim:

1. Crystalliser for the continuous casting of billets, blooms, slabs, and round bars along a longitudinal casting axis, the crystalliser comprising:

cooled sidewalls having, in at least one longitudinal area, at least one perimeter area with elements of electrical insulation defining two electrically insulated ends, the sidewall of the crystalliser extending between the insulated ends having an electrical continuity;

electrical connectors connected to the insulated ends for applying a current in a direction parallel to the sidewalls and perpendicular to the longitudinal casting axis; and a power supply system governing electrical power supplied to the electrical connectors to generate a pulsating electromagnetic field in a direction substantially parallel to and migrating along the longitudinal casting axis and corresponding forces in a direction perpendicular to the longitudinal casting axis and to the sidewalls and interacting at least with the skin forming in the cast metal.

2. Crystalliser as in claim 1, in which the at least one perimeter area of the sidewalls extends circumferentially and the two electrically insulated ends define an insulated corner substantially parallel to the axis of the crystalliser.

3. Crystalliser as in claim 1, which is defined by a plurality of longitudinal areas, each of which being associated to its own specific electrical supply connected to specific channels of the electrical power supply system.

4. Crystalliser as in claim 3, in which each area longitudinal is electrically insulated with respect to the nearby longitudinal area.

5. Crystalliser as in claim 1, further comprising means for concentrating current near an inner edge of the sidewalls.

6. Crystalliser as in claim 2, in which there is, in the electricity-conducting corners, an insulating layer arranged along at least a segment of the corners near an inner edge.

7. Crystalliser as in claim 1, in which the inner face of the sidewalls is lined with an insulating layer (23).

8. Crystalliser as in claim 5, in which the means for concentrating current comprises a reduction in the thickness of the sidewalls at the electricity-conducting corners.

9. Crystalliser as in claim 2, in which there are insulating inserts in correspondence with the corners defining a limited segment of electrical contact.

10. Crystalliser as in claim 1, in which there are notches on the outer face of the sidewalls.

11. Crystalliser as in claim 1, further comprising notches on the inner face of the sidewalls for delimiting zones in which the power supply system can act independently.

12. Continuous casting method for billets, blooms, slabs round bars and other products, for use in a crystalliser containing cast metal, comprising:

casting the metal along a longitudinal casting axis through the crystalliser, thereby forming a skin having a thickness increasing towards an outlet of the crystalliser;

supplying a current from an electrical power supply to at least two electrically insulated ends of at least one circumferential part of at least one longitudinal part of the sidewalls of the crystalliser to apply the current to the sidewalls in a direction parallel to the sidewalls and perpendicular to the longitudinal casting axis;

controlling the electrical power supply to induce on the cast metal pulsating currents of an intensity up to 150 kA and to generate an electromagnetic field in a direction substantially parallel to and migrating along the longitudinal casting axis and corresponding forces in a direction substantially perpendicular to the longitudinal casting axis and to the sidewalls and interacting at least with the skin forming in the cast metal.

13. Method as in claim 12, in which the sidewall of the crystalliser includes a plurality of parts arranged lengthwise to define electrically fed areas and that the magnetic field induced on the cast metal migrates along the longitudinal extent of the crystalliser, each of the areas being associated with its own electrical power supply connected to the relative channels of a power supply system defined by its own specific parameters of the quantity of electricity supplied, at least in terms of the frequency of repetition and intensity.

14. Method as in claim 13, further comprising individually controlling the supply channels in terms of the form of the pulse and the duration.

15. Method as in claim from 12, in which electromagnetic forces (F) induced in the cast metal have characteristics of application which can be varied both according to time and according to their relative position with respect to the crystalliser.

16. Method as in claim 15, in which in correspondence with the meniscus the force generated has a frequency of application in the interval of between 5–60 Hz.

17. Method as in claim 15, in which in correspondence with the lower part of the crystalliser the force generated has a frequency of application in the interval of between 5–40 Hz.

18. Method as in claim 17, in which the force generated has maximum intensity.

19. Method as in claim 13, further comprising controlling the quantity of electrical power supplied to the individual areas to provide a condition close to the condition of resonance of the material subtended by the specific area of the crystalliser.

20. Method as in claim 12, further comprising controlling the magnetic field generated to produce on the meniscus volumetric waves so as to cause the just solidified skin to become detached from the sidewalls of the crystalliser.

21. Method as in claim 20, in which the volumetric waves are stationary and cause the skin to become detached from the sidewalls at a substantially fixed value.

22. Method as in claim 20, in which the volumetric waves are progressive and cause the skin to become detached from the sidewalls periodically.

23. Method as in claim 22, in which the periodic separation of the solidified skin at the meniscus causes a pump effect which starts the local atmosphere moving at supersonic speeds and increases heat exchange between the sidewalls and the solidified skin.

24. Method as in claim 12, further comprising controlling the magnetic field generated to achieve in the cast metal a stirring effect with a differentiated intensity and frequency along the extent of the crystalliser.

25. Method as in claim 12, further comprising controlling the pulsating magnetic field to generate electromagnetic waves having a progressively retarded development, in a lengthwise direction to the crystalliser, so as to assume a following configuration with an intensity which grows towards the outlet of the crystalliser.

* * * * *